US009617949B2

(12) United States Patent
Baek et al.

(10) Patent No.: US 9,617,949 B2
(45) Date of Patent: Apr. 11, 2017

(54) CYLINDER HEAD FOR ENGINE

(71) Applicant: Hyundai Motor Company, Seoul (KR)

(72) Inventors: Hongkil Baek, Seoul (KR); Jiyoun Seo, Suwon-si (KR); Bokyung Kim, Yongin-si (KR); Seungwoo Lee, Seoul (KR); Minkyu Park, Yongin-si (KR); Inwoong Lyo, Suwon-si (KR); Dongkyu Lee, Anyang-si (KR)

(73) Assignee: Hyundai Motor Company, Seoul (KR)

( * ) Notice: Subject to any disclaimer, the term of this patent is extended or adjusted under 35 U.S.C. 154(b) by 89 days.

(21) Appl. No.: 14/526,027

(22) Filed: Oct. 28, 2014

(65) Prior Publication Data

US 2015/0300289 A1 Oct. 22, 2015

(30) Foreign Application Priority Data

Apr. 18, 2014 (KR) ..... 10-2014-0046908

(51) Int. Cl.
*F02F 1/24* (2006.01)

(52) U.S. Cl.
CPC ..... *F02F 1/24* (2013.01); *F05C 2251/048* (2013.01); *F05C 2253/12* (2013.01); *F05C 2253/20* (2013.01)

(58) Field of Classification Search
CPC ..... F05C 2253/12; F05C 2253/20; F02F 1/24; F02F 7/0087; F02F 1/18; F02F 2001/008; F02F 3/10
USPC ..... 123/193.5, 193.1, 193.6, 193.3; 521/91, 521/122, 145
See application file for complete search history.

(56) References Cited

U.S. PATENT DOCUMENTS

| | | | | |
|---|---|---|---|---|
| 3,243,397 | A * | 3/1966 | Herkimer | B22C 3/00 106/38.22 |
| 4,398,527 | A * | 8/1983 | Rynbrandt | C08J 9/32 123/188.3 |
| 4,796,572 | A * | 1/1989 | Heydrich | F01P 9/00 123/193.2 |
| 5,133,316 | A * | 7/1992 | Kasai | C08L 51/06 123/198 E |
| 5,984,317 | A * | 11/1999 | Grant-Acquah | F16J 15/122 277/592 |
| 6,026,568 | A * | 2/2000 | Atmur | F02B 41/00 264/640 |
| 6,619,665 | B2 * | 9/2003 | Miyaoh | F16J 15/0825 277/591 |
| 7,468,205 | B2 * | 12/2008 | Schwertfeger | B32B 27/18 428/220 |
| 2003/0084891 | A1 * | 5/2003 | Gillston | F02B 51/02 123/670 |
| 2011/0303197 | A1 * | 12/2011 | Chung | B01D 53/002 123/518 |

(Continued)

FOREIGN PATENT DOCUMENTS

| | | | | |
|---|---|---|---|---|
| JP | EP 2175116 A1 * | 4/2010 | | F02B 77/02 |
| KR | 10-2010-0033396 A | 3/2010 | | |

(Continued)

*Primary Examiner* — Long T Tran
(74) *Attorney, Agent, or Firm* — Morgan, Lewis & Bockius LLP

(57) ABSTRACT

A cylinder head for an engine may include an adiabatic coating layer having a polyamideimide resin and an aerogel dispersed in the polyamideimide resin with thermal conductivity of 0.60 W/m or less formed on a surface of a combustion chamber.

14 Claims, 3 Drawing Sheets

(56) References Cited

U.S. PATENT DOCUMENTS

| | | | | |
|---|---|---|---|---|
| 2012/0088855 | A1* | 4/2012 | Gawryla | B01J 13/0091 521/91 |
| 2013/0118457 | A1* | 5/2013 | Chung | B01D 53/002 123/520 |

FOREIGN PATENT DOCUMENTS

| | | | | |
|---|---|---|---|---|
| KR | 10-1083133 | B1 | 11/2011 | |
| KR | WO 2011145758 | A1 * | 11/2011 | F02B 19/108 |
| WO | WO 2009/020206 | A1 | 2/2009 | |

* cited by examiner

CYLINDER HEAD FOR ENGINE

CROSS-REFERENCE TO RELATED APPLICATION

The present application claims priority to Korean Patent Application No. 10-2014-0046908 filed Apr. 18, 2014, the entire contents of which is incorporated herein for all purposes by this reference.

BACKGROUND OF THE INVENTION

Field of the Invention

The present invention relates to an engine for a vehicle, and more particularly, to a cylinder head in which an adiabatic coating layer is formed on a surface of a combustion chamber.

Description of Related Art

Generally, an internal combustion engine refers to an engine where a fuel gas generated by combusting a fuel directly acts to a piston, a turbine blade, or the like to convert heat energy of the fuel into mechanical work.

In many cases, the internal combustion engine refers to a reciprocal motion type engine igniting a mixture gas of the fuel and air in a cylinder to cause an explosion and thus move a piston, but a gas turbine, a jet engine, a rocket, and the like are the internal combustion engine.

The internal combustion engine is classified into a gas engine, a gasoline engine, a petroleum engine, a diesel engine, and the like by the used fuel. The petroleum, gas, and gasoline engines cause ignition by an electric flame by a spark plug, and the diesel engine sprays the fuel into air at high temperatures and high pressure to cause spontaneous ignition. There are four and two stroke cycle methods according to a stroke and an operation of the piston.

Typically, it is known that the internal combustion engine of a vehicle has heat efficiency of about 15% to 35%, about 60% or more of total heat energy is consumed due to heat energy emitted to the outside through a wall of the internal combustion engine, an exhaust gas, and the like at maximum efficiency of the internal combustion engine.

As described above, if a quantity of heat energy emitted to the outside through the wall of the internal combustion engine is reduced, since efficiency of the internal combustion engine may be increased, methods of installing an adiabatic material outside of the internal combustion engine, changing a portion of a material or a structure of the internal combustion engine, or developing a cooling system of the internal combustion engine are used.

Particularly, if emission of heat generated in the internal combustion engine through the wall of the internal combustion engine to the outside is minimized, efficiency of the internal combustion engine and fuel efficiency of the vehicle may be improved, but researches for an adiabatic material, an adiabatic structure, or the like which may be maintained over a long period of time in the internal combustion engine to which a repeated high temperature and high pressure condition is applied are in an insignificant situation.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cylinder head for an engine, which reduces heat energy emitted to the outside to improve efficiency of an internal combustion engine and fuel efficiency of a vehicle by applying an adiabatic coating layer having low thermal conductivity and a low volume thermal capacity and also securing high mechanical properties and heat resistance to a surface of a combustion chamber.

According to various aspects of the present invention, a cylinder head for an engine may include an adiabatic coating layer having a polyamideimide resin and an aerogel dispersed in the polyamideimide resin with thermal conductivity of 0.60 W/m or less formed on a surface of a combustion chamber.

The adiabatic coating layer may have a thermal capacity of 1250 KJ/m3 K or less.

The polyamideimide resin may exist in a content of 2 wt % or less in the aerogel.

The polyamideimide resin may not exist at a depth corresponding to 5% or more of a longest diameter from a surface of the aerogel.

Each aerogel may have porosity of 92% to 99% while being dispersed in the polyamideimide resin.

The adiabatic coating layer may have a thickness of 50 μm to 500 μm.

The adiabatic coating layer may include 5 to 50 parts by weight of the aerogel based on 100 parts by weight of the polyamideimide resin.

The adiabatic coating layer including the polyamideimide resin may be dispersed in a high boiling point organic solvent or aqueous solvent and the aerogel may be dispersed in a low boiling point organic solvent as the adiabatic coating layer.

The high boiling point solvent may include anisole, toluene, xylene, methyl ethyl ketone, methyl isobutyl ketone, ethyleneglycol monomethylether, ethyleneglycol monoethylether, ethyleneglycol monobutylether, butyl acetate, cyclohexanone, ethyleneglycol monoethylether acetate (BCA), benzene, hexane, DMSO, N,N'-dimethylformamide, or a mixture of two or more kinds thereof.

The low boiling point organic solvent may include methyl alcohol, ethyl alcohol, propyl alcohol, n-butyl alcohol, isobutyl alcohol, tert-butyl alcohol, acetone, methylene chloride, ethylene acetate, isopropyl alcohol, or a mixture of two or more kinds thereof.

The aqueous solvent may include water, methanol, ethanol, ethyl acetate, or a mixture of two or more kinds thereof.

The adiabatic coating layer may have a thermal conductivity of 0.54 W/m or less in a thickness of 120 to 200 μm.

The aerogel may include one or more kinds of compounds selected from the group consisting of silicon oxide, carbon, polyimide, and metal carbide.

The polyamideimide resin may have a weight average molecular weight of 3,000 to 300,000 or 4,000 to 100,000.

The aerogel may have a specific surface area of 100 cm3/g to 1,000 cm3/g, or 300 cm3/g to 900 cm3/g.

According to the exemplary embodiment of the present invention, it is possible to reduce heat energy emitted to the outside to improve efficiency of an internal combustion engine and fuel efficiency of a vehicle by applying an adiabatic coating layer securing high mechanical properties and heat resistance while having low thermal conductivity and a low volume thermal capacity to a surface of a combustion chamber.

Moreover, according to the exemplary embodiment of the present invention, it is possible to promote improvement of fuel efficiency of a vehicle by reducing a cooling loss due to a reduction in temperature difference between a combustion gas and a wall of a combustion chamber during an expansion stroke.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Throughout the specification, unless explicitly described to the contrary, the word "comprise" and variations such as "comprises" or "comprising", will be understood to imply the inclusion of stated elements but not the exclusion of any other elements.

In addition, the terms " . . . unit", " . . . means", " . . . part", and " . . . member" described in the specification mean units of comprehensive constitutions for performing at least one function and operation.

Figure 1:
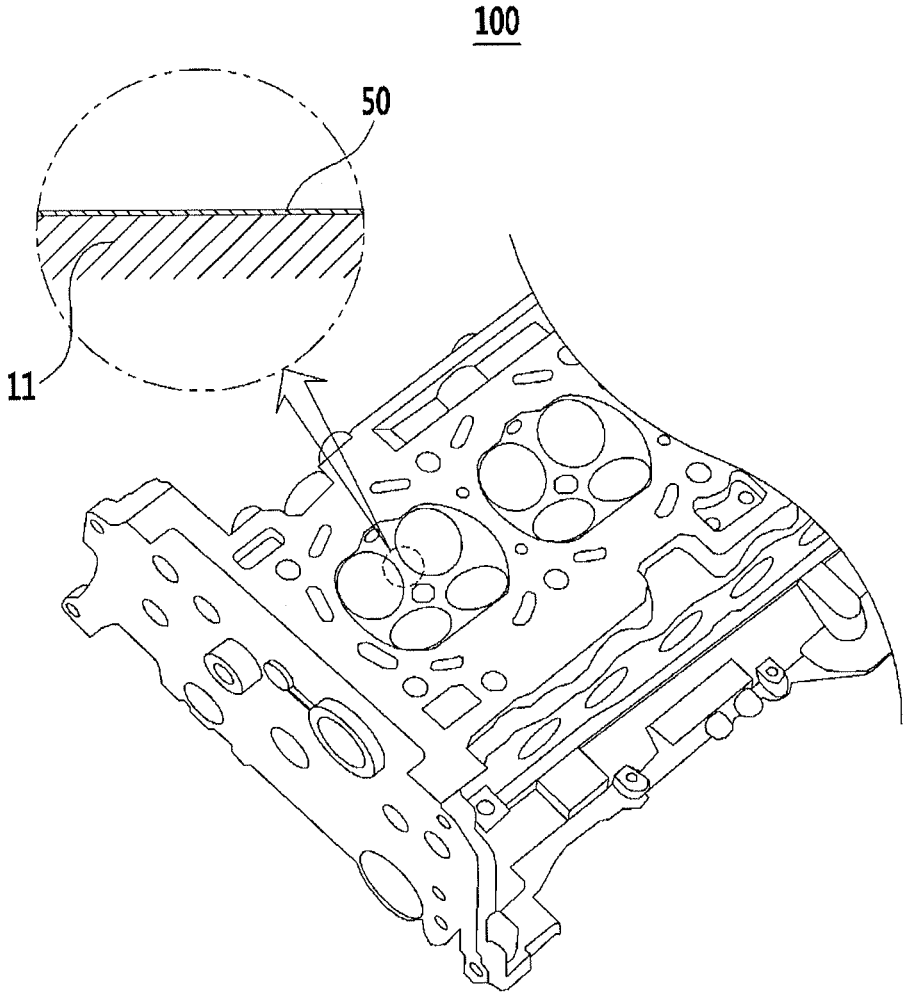
FIG. 1 is a view schematically illustrating an exemplary cylinder head for an engine according to the present invention.

FIG. 1 is a view schematically illustrating a cylinder head for an engine according to various embodiments of the present invention.

Referring to FIG. 1, in a cylinder head 100 for an engine according to various embodiments of the present invention, a combustion chamber 11 for combusting a fuel and air is formed.

Hereinafter, application of the cylinder head 100 according to various embodiments of the present invention to an engine of a vehicle is described as an example, but it should be understood that the protection scope of the present invention is not essentially limited thereto, and as long as the cylinder head has a cylinder combustion chamber structure adopted in various kinds of internal combustion engines for the various purposes, such as a gas turbine, a jet engine, and a rocket, the technical spirit of the present invention may be applied to the cylinder head.

The cylinder head 100 for the engine according to various embodiments of the present invention has a structure in which heat energy emitted to the outside is reduced to improve efficiency of the internal combustion engine and fuel efficiency of the vehicle by applying an adiabatic coating layer 50 having low thermal conductivity and a low volume thermal capacity and also securing high mechanical properties and heat resistance to a surface of the combustion chamber 11.

That is, the exemplary embodiment of the present invention provides the cylinder head 100 for the engine, which can promote improvement of fuel efficiency of the vehicle by reducing a cooling loss due to a reduction in temperature difference between a combustion gas and a wall of the combustion chamber during an expansion stroke. To this end, in the cylinder head 100 for the engine according to various embodiments of the present invention, the adiabatic coating layer 50 is formed on the surface of the combustion chamber 11.

Hereinafter, the adiabatic coating layer 50 applied to the combustion chamber 11 of the cylinder head 100 for the engine according to various embodiments of the present invention, and an adiabatic coating composition thereof will be described in more detail.

Various embodiments of the present invention provide the adiabatic coating composition including a polyamideimide resin dispersed in a high boiling point organic solvent or aqueous solvent and an aerogel dispersed in a low boiling point organic solvent as the adiabatic coating layer.

Further, the adiabatic coating layer according to various embodiments of the present invention includes the polyamideimide resin and the aerogel dispersed in the polyamideimide resin, and has thermal conductivity of 0.60 W/m or less.

According to various embodiments of the present invention, the adiabatic coating composition including the polyamideimide resin dispersed in the high boiling point organic solvent or aqueous solvent and the aerogel dispersed in the low boiling point organic solvent may be provided.

The present inventors confirmed through an experiment that the coating composition obtained by dispersing the polyamideimide resin and the aerogel in predetermined solvents, respectively and then mixing the resultant solutions, and the coating layer obtained therefrom could secure high mechanical properties and heat resistance while having lower thermal conductivity and low density, and are applied to the internal combustion engine to reduce heat energy emitted to the outside and thus improve efficiency of the internal combustion engine and fuel efficiency of the vehicle, thereby accomplishing the invention.

Recently, methods of using the aerogel (or air-gel) have been introduced in fields such as an adiabatic material, an impact limiter, or a soundproofing material. This aerogel has a structure formed by entangling microfilaments having a thickness that is a ten-thousandth of that of a hair, and has porosity of 90% or more, and main materials thereof are silicon oxide, carbon, or an organic polymer. Particularly, the aerogel is an ultra-low density material having high translucency and ultra-low thermal conductivity due to the aforementioned structural characteristic.

However, since the aerogel is easily broken by small impact due to high brittleness to exhibit very poor strength and it is difficult to process the aerogel to have various thicknesses and shapes, there is a predetermined limitation in application to the adiabatic material even though the aerogel has an excellent adiabatic characteristic, and in the case where the aerogel and other reactant are mixed, there are problems in that since a solvent or a solute permeates an inside of the aerogel to increase viscosity of a compound and thus make mixing unfeasible, it is difficult to perform complexation with the other material or use after mixing with the other material, and a characteristic of the porous aerogel is not exhibited.

On the other hand, in the adiabatic coating composition of the exemplary embodiment, the polyamideimide resin exists while being dispersed in the high boiling point organic solvent or aqueous solvent and the aerogel exists while being dispersed in the low boiling point organic solvent, and thus a solvent dispersion phase of the polyamideimide resin and a solvent dispersion phase of the aerogel do not agglomerate but may be uniformly mixed, and the adiabatic coating composition may have a homogeneous composition.

Moreover, since the high boiling point organic solvent or aqueous solvent and the low boiling point organic solvent are not easily mutually dissolved or mixed, the polyamideimide resin and the aerogel are mixed while the polyamideimide resin is dispersed in the high boiling point organic solvent or aqueous solvent and the aerogel is dispersed in the low boiling point organic solvent to form the coating composition, and thus direct contact between the polyamideimide resin and the aerogel may be minimized until the adiabatic coating composition of various embodiments of the present invention is applied and dried, and the polyamideimide resin may be prevented from permeating the inside of the aerogel or the pore or being impregnated in the aerogel or the pore.

Further, since the low boiling point organic solvent has predetermined affinity with the high boiling point organic solvent or aqueous solvent, the low boiling point organic solvent may serve to materially mix the aerogel dispersed in the low boiling point organic solvent and the polyamideimide resin dispersed in the high boiling point organic solvent or aqueous solvent and thus uniformly distribute the aerogel and uniformly distribute the polyamideimide resin in the high boiling point organic solvent or aqueous solvent.

Accordingly, in the adiabatic coating layer obtained from the adiabatic coating composition of various embodiments of the present invention, physical properties of the aerogel may be secured at the same level or more, and the aerogel may be more uniformly dispersed in the polyamideimide resin to implement improved adiabatic characteristics together with high mechanical properties and heat resistance.

That is, as described above, in the adiabatic coating layer obtained from the adiabatic coating composition, since physical properties and the structure of the aerogel may be maintained at the same level, high mechanical properties and heat resistance may be secured while the adiabatic coating layer has lower thermal conductivity and lower density, and the adiabatic coating layer may be applied to the internal combustion engine to reduce heat energy emitted to the outside and thus improve efficiency of the internal combustion engine and fuel efficiency of the vehicle.

Herein, the adiabatic coating layer, as illustrated in FIG. 1, may be applied to the surface of the combustion chamber 11 of the cylinder head 100.

Meanwhile, the adiabatic coating composition of various embodiments of the present invention may be formed by mixing the polyamideimide resin dispersed in the high boiling point organic solvent or aqueous solvent and the aerogel dispersed in the low boiling point organic solvent as described above.

The mixing method is not largely limited, and any typically known physical mixing method may be used. For example, there may be a method of manufacturing a coating composition (coating solution) by mixing two kinds of solvent dispersion phases, adding a zirconia bead thereto, and performing ball milling under a condition of a temperature of room temperature and normal pressure at a speed of 100 to 500 rpm. However, the mixing method of the solvent dispersion phases of the polyamideimide resin and the aerogel is not limited to the aforementioned example.

The adiabatic coating composition of various embodiments of the present invention may provide the adiabatic material, an adiabatic structure, and the like which may be maintained over a long period of time in the internal combustion engine to which a repeated high temperature and high pressure condition is applied, and specifically, the adiabatic coating composition of various embodiments of the present invention may be used in coating of an internal surface of the internal combustion engine or parts of the internal combustion engine, and furthermore, as described above, may be used in coating of the surface of the combustion chamber of the cylinder head.

An example of the polyamideimide resin which may be included in the adiabatic coating composition of various embodiments of the present invention is not largely limited, but the polyamideimide resin may have a weight average molecular weight of 3,000 to 300,000, or 4,000 to 100,000.

If the weight average molecular weight of the polyamideimide resin is very small, it may be difficult to sufficiently secure mechanical properties, heat resistance, and an adiabatic property of a coating layer, a coating film, or a coating membrane obtained from the adiabatic coating composition, and a polymer resin may easily permeate the inside of the aerogel.

Further, if the weight average molecular weight of the polyamideimide resin is very large, uniformity or homogeneity of the coating layer, the coating film, or the coating membrane obtained from the adiabatic coating composition may deteriorate, dispersibility of the aerogel in the adiabatic coating composition may be reduced or a nozzle and the like of a coating device may be clogged when the adiabatic coating composition is applied, a heat-treating time of the adiabatic coating composition may be prolonged, and a heat-treating temperature may be increased.

A typical aerogel known in the art may be used as the aforementioned aerogel, and specifically, the aerogel of components including silicon oxide, carbon, polyimide, metal carbide, or a mixture of two or more kinds thereof may be used. The aerogel may have a specific surface area of 100 cm3/g to 1,000 cm3/g, or 300 cm3/g to 900 cm3/g.

The adiabatic coating composition may include the aerogel in a content of 5 to 50 parts by weight or 10 to 45 parts by weight based on 100 parts by weight of the polyamideimide resin. A weight ratio of the polyamideimide resin and the aerogel is a weight ratio of solids other than the dispersion solvent.

If the content of the aerogel based on the polyamideimide resin is very small, it may be difficult to reduce thermal conductivity and density of the coating layer, the coating film, or the coating membrane obtained from the adiabatic coating composition, it may be difficult to secure a sufficient adiabatic property, and heat resistance of the adiabatic membrane manufactured from the adiabatic coating composition may be reduced.

Further, if the content of the aerogel based on the polymer resin is very large, it may be difficult to sufficiently secure mechanical properties of the coating layer, the coating film, or the coating membrane obtained from the adiabatic coating composition, cracks may be generated in an adiabatic film manufactured from the adiabatic coating composition, or it may be difficult to maintain a strong coat form of the adiabatic film.

The solid content of the polyamideimide resin of the high boiling point organic solvent or aqueous solvent is not largely limited, but the solid content may be 5 wt % to 75 wt % in consideration of uniformity or physical properties of the adiabatic coating composition.

Further, the solid content of the aerogel of the low boiling point organic solvent is not largely limited, but the solid content may be 5 wt % to 75 wt % in consideration of uniformity or physical properties of the adiabatic coating composition.

As described above, since the high boiling point organic solvent or aqueous solvent and the low boiling point organic solvent are not easily mutually dissolved or mixed, direct contact between the polyamideimide resin and the aerogel may be minimized until the adiabatic coating composition of various embodiments of the present invention is applied and dried, and the polyamideimide resin may be prevented from permeating the inside of the aerogel or the pore or being impregnated in the aerogel or the pore.

Specifically, a boiling point difference between the high boiling point organic solvent and the low boiling point organic solvent may be 10° C. or more, 20° C. or more, or 10 to 200° C. As the high boiling point organic solvent, an organic solvent having the boiling point of 110° C. or more may be used.

Specific examples of the high boiling point solvent may include anisole, toluene, xylene, methyl ethyl ketone, methyl isobutyl ketone, ethyleneglycol monomethylether, ethyleneglycol monoethylether, ethyleneglycol monobutylether, butyl acetate, cyclohexanone, ethyleneglycol monoethylether acetate (BCA), benzene, hexane, DMSO, N,N'-dimethylformamide, or a mixture of two or more kinds thereof.

As the low boiling point organic solvent, an organic solvent having the boiling point of less than 110° C. may be used.

Specific examples of the low boiling point organic solvent may include methyl alcohol, ethyl alcohol, propyl alcohol, n-butyl alcohol, iso-butyl alcohol, tert-butyl alcohol, acetone, methylene chloride, ethylene acetate, isopropyl alcohol, or a mixture of two or more kinds thereof.

Meanwhile, specific examples of the aqueous solvent may include water, methanol, ethanol, ethyl acetate, or a mixture of two or more kinds thereof.

On the other hand, according to various embodiments of the present invention, an adiabatic coating layer including a polyamideimide resin and an aerogel dispersed in the polyamideimide resin and having thermal conductivity of 0.60 W/m or less may be provided.

The present inventors manufactured the adiabatic coating layer which could have low thermal conductivity and low density and also secure high mechanical properties and heat resistance, and be applied to an internal combustion engine to reduce heat energy emitted to the outside and thus improve efficiency of the internal combustion engine and fuel efficiency of a vehicle by using the aforementioned adiabatic coating composition of the exemplary embodiment.

In the adiabatic coating layer, the aerogel is uniformly dispersed over an entire region of the polyamideimide resin, and thus physical properties implemented from the aerogel, for example, low thermal conductivity and low density may be more easily secured, and a characteristic revealed from the polyamideimide resin, for example, high mechanical properties, heat resistance, and the like, may be implemented at the same level as the case where only the polyamideimide resin is used or more.

The adiabatic coating layer may have low thermal conductivity and the high thermal capacity, and specifically, the adiabatic coating layer may have thermal conductivity of 0.60 W/m or less, 0.55 W/m or less, or 0.60 W/m to 0.200 W/m, and the adiabatic coating layer may have the thermal capacity of 1250 KJ/m3 K or less or 1000 to 1250 KJ/m3 K.

Meanwhile, as described above, since the adiabatic coating composition various embodiments of the present invention includes the polyamideimide resin dispersed in the high boiling point organic solvent or aqueous solvent and the aerogel dispersed in the low boiling point organic solvent, direct contact between the polyamideimide resin and the aerogel may be minimized until the coating composition is applied and dried, and thus the polyamideimide resin may not permeate the inside of the aerogel or the pore or not be impregnated in the aerogel or the pore included in the finally manufactured adiabatic coating layer.

Specifically, the polyamideimide resin may not substantially exist in the aerogel dispersed in the polyamideimide resin, and for example, the polyamideimide resin may exist in a content of 2 wt % or less or 1 wt % or less in the aerogel.

Further, in the adiabatic coating layer, the aerogel may exist while being dispersed in the polyamideimide resin, and in this case, the outside of the aerogel may be in contact with or combined with the polyamideimide resin, but the polyamideimide resin may not exist in the aerogel. Specifically, the polyamideimide resin may not exist at a depth corresponding to 5% or more of a longest diameter from a surface of the aerogel included in the adiabatic coating layer.

Since the polyamideimide resin does not permeate the inside of the aerogel or the pore or is not impregnated in the aerogel or the pore, the aerogel may have the same level of porosity before and after the aerogel is dispersed in the polyamideimide resin, and specifically, each aerogel included in the adiabatic coating layer may have porosity of 92% to 99% while being dispersed in the polyamideimide resin.

The adiabatic coating layer of various embodiments of the present invention may provide an adiabatic material, an adiabatic structure, and the like which may be maintained over a long period of time in the internal combustion engine to which a repeated high temperature and high pressure condition is applied, and specifically, the adiabatic coating layer of various embodiments of the present invention may be formed on an internal surface of the internal combustion engine or a surface of a combustion chamber of a cylinder head of the internal combustion engine.

A thickness of the adiabatic coating layer may be determined according to an application field or position, or required physical properties, and for example, may be 50 μm to 500 μm.

The adiabatic coating layer of the exemplary embodiment may include the aerogel in a content of 5 to 50 parts by weight or 10 to 45 parts by weight based on 100 parts by weight of the polyamideimide resin.

If the content of the aerogel based on the polyamideimide resin is very small, it may be difficult to reduce thermal conductivity and density of the adiabatic coating layer, it may be difficult to secure a sufficient adiabatic property, and heat resistance of the adiabatic coating layer may be reduced. Further, if the content of the aerogel based on the polymer resin is very large, it may be difficult to sufficiently secure mechanical properties of the adiabatic coating layer, cracks of the adiabatic coating layer may be generated, or it may be difficult to maintain a strong coat form of the adiabatic membrane.

The polyamideimide resin may have a weight average molecular weight of 3,000 to 300,000 or 4,000 to 100,000.

The aerogel may include one or more kinds of compounds selected from the group consisting of silicon oxide, carbon, polyimide, and metal carbide.

The aerogel may have a specific surface area of 100 cm3/g to 1,000 cm3/g.

A specific content of the polyamideimide resin and the aerogel includes the aforementioned content of the adiabatic coating composition of various embodiments of the present invention Meanwhile, the adiabatic coating layer of the various embodiments of the present invention may be obtained by drying the adiabatic coating composition. A device or a method which may be used in drying of the adiabatic coating composition is not largely limited, and a spontaneous drying method at a temperature of room temperature or more, a drying method by heating to a temperature of 50° C. or more, or the like may be used.

For example, the adiabatic coating composition may be applied on a coating target, for example, the internal surface of the internal combustion engine or an external surface of parts of the internal combustion engine, and semi-dried at a temperature of 50° C. to 200° C. one or more times, and the semi-dried coating composition may be completely dried at a temperature of 200° C. or more to form the adiabatic coating layer. However, a specific manufacturing method of the adiabatic coating layer of the various embodiment is not limited thereto.

The present invention will be described in more detail in the following Examples. However, the following Examples are set forth to illustrate the present invention but are not to be construed to limit the present invention.

EXAMPLES 1 to 3

Manufacturing of Adiabatic Coating Composition

The porous silica aerogel (specific surface area: about 500 cm3/g) dispersed in ethyl alcohol and the polyamideimide resin (products manufactured by Solvay SA, weight average molecular weight: about 11,000) dispersed in xylene were injected into the 20 g reactor, the zirconia bead was added (440 g), and ball milling was performed under the room temperature and normal pressure condition at the speed of 150 to 300 rpm to manufacture the adiabatic coating composition (coating solution).

In this case, the weight ratio of the porous silica aerogel based on the polyamideimide resin is the same as the matter described in the following Table 1.

(2) Forming of Adiabatic Coating Layer

The obtained adiabatic coating composition was applied on a part for a vehicle engine by a spray coating method. In addition, the adiabatic coating composition was applied on the part, primary semi-drying was performed at about 150° C. for about 10 minutes, the adiabatic coating composition was re-applied, and secondary semi-drying was performed at about 150° C. for about 10 minutes. After secondary semi-drying, the adiabatic coating composition was applied again, and complete drying was performed at about 250° C. for about 60 minutes to form the adiabatic coating layer on the part. In this case, the thickness of the formed coating layer is the same as the matter described in the following Table 1.

COMPARATIVE EXAMPLE 1

The solution (PAI solution) of the polyamideimide resin (products manufactured by Solvay SA, weight average molecular weight: about 11,000) dispersed in xylene was applied on a part for a vehicle engine by the spray coating method.

In addition, the PAI solution was applied on the part, primary semi-drying was performed at about 150° C. for about 10 minutes, the PAI solution was re-applied, and secondary semi-drying was performed at about 150° C. for about 10 minutes. After the secondary semi-drying, the PAI solution was applied again, and complete drying was performed at about 250° C. for about 60 minutes to form the adiabatic coating layer on the part. In this case, the thickness of the formed coating layer is the same as the matter described in the following Table 1.

COMPARATIVE EXAMPLE 2

Manufacturing of Coating Composition

The porous silica aerogel (specific surface area: about 500 cm3/g) and the polyamideimide resin (products manufactured by Solvay SA, weight average molecular weight: about 11,000) dispersed in xylene were injected into the 20 g reactor, the zirconia bead was added (440 g), and ball milling was performed under the room temperature and normal pressure condition at the speed of 150 to 300 rpm to manufacture the coating composition (coating solution).

In this case, the weight ratio of the porous silica aerogel based on the polyamideimide resin is the same as the matter described in the following Table 1.

(2) Forming of Adiabatic Coating Layer

The coating layer having the thickness of about 200 μm was formed by the same method as Example 1.

EXPERIMENTAL EXAMPLE

Experimental Example 1

Measurement of Thermal Conductivity

Thermal conductivity of the coating layers on the parts obtained in the Examples and the Comparative Examples was measured on the basis of ASTM E1461 under the room temperature and normal pressure condition using the laser flash method by the thermal diffusion measuring method.

Experimental Example 2

Measurement of Thermal Capacity

The thermal capacity was confirmed by measuring specific heat of the coating layers on the parts obtained in the Examples and the Comparative Examples on the basis of ASTM E1269 under the room temperature condition using the DSC device and using sapphire as a reference.

TABLE 1

| | Content of aerogel based on 100 parts by weight of PAI resin (parts by weight) | Thickness of coating layer (μm) | Thermal conductivity of coating layer [W/m] | Thermal capacity of coating layer [KJ/m$^3$ K] |
|---|---|---|---|---|
| Example 1 | 15 | 120 | 0.54 | 1216 |
| Example 2 | 20 | 200 | 0.331 | 1240 |
| Example 3 | 40 | 200 | 0.294 | 1124 |
| Comparative Example 1 | — | 200 | 0.56 | 1221 |

As described in Table 1, it was confirmed that the adiabatic coating layer obtained in Examples 1 to 3 had the thermal capacity of 1240 KJ/m3 K or less and thermal conductivity of 0.54 W/m or less in the thickness of 120 to 200 μm. Accordingly, the adiabatic coating layer obtained in Examples 1 to 3 may be applied to coating of the parts of the internal combustion engine to reduce heat energy emitted to the outside and thus improve efficiency of the internal combustion engine and fuel efficiency of the vehicle.

Figure 2:
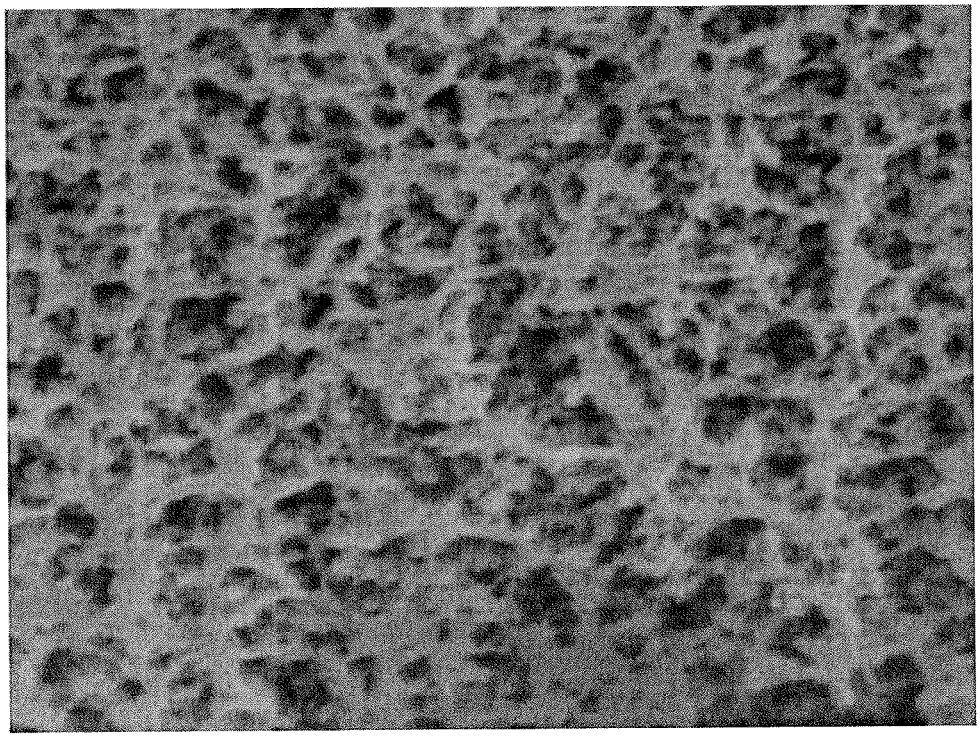
FIG. 2 is a picture illustrating a surface of an adiabatic coating layer obtained in the exemplary cylinder head for the engine according to the present invention.

Further, as illustrated in FIG. 2, it can be confirmed that in the adiabatic coating layer manufactured in Example 1, the polyamideimide resin does not permeate the inside of the aerogel and almost 92% or more of the pores in the aerogel are maintained.

Figure 3:
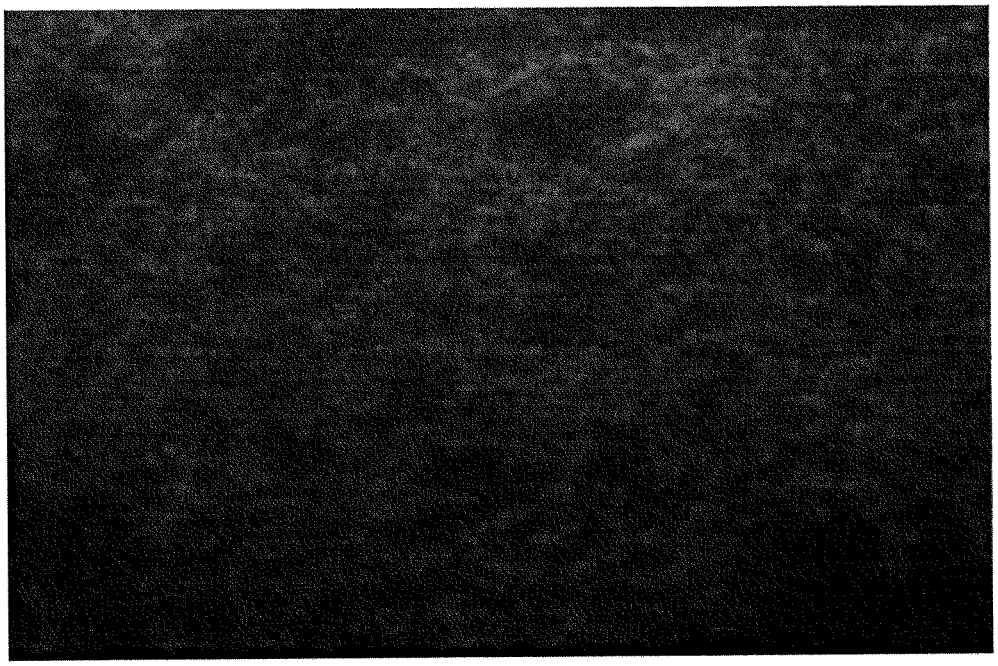
FIG. 3 is a picture illustrating a surface of a coating layer obtained in a Comparative Example as compared to the exemplary cylinder head for the engine according to the present invention.

On the other hand, in the coating layer manufactured in Comparative Example 2, as illustrated in FIG. 3, the polyamideimide resin permeated the inside of the aerogel, and thus the pores were hardly observed.

According to the aforementioned cylinder head 100 for the engine according various embodiments of the present invention, it is possible to reduce heat energy emitted to the outside to improve efficiency of the internal combustion engine and fuel efficiency of the vehicle by applying the adiabatic coating layer securing high mechanical properties and heat resistance while having low thermal conductivity and the low volume thermal capacity to the surface of the combustion chamber.

Moreover, in various embodiments of the present invention, it is possible to promote improvement of fuel efficiency of the vehicle by reducing a cooling loss due to a reduction in temperature difference between a combustion gas and a wall of the combustion chamber during an expansion stroke.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cylinder head for an engine, comprising:

an adiabatic coating layer including a polyamideimide resin and an aerogel dispersed in the polyamideimide resin and having thermal conductivity of 0.60 W/m or less formed on a surface of a combustion chamber, wherein the polyamideimide resin does not exist at a depth corresponding to 5% or more of a longest diameter from a surface of the aerogel.

2. The cylinder head for an engine of claim 1, wherein: the adiabatic coating layer has a thermal capacity of 1250 KJ/m$^3$ K or less.

3. The cylinder head for an engine of claim 1, wherein: the polyamideimide resin exists in a content of 2 wt % or less in the aerogel.

4. The cylinder head for an engine of claim 1, wherein: each aerogel has porosity of 92% to 99% while being dispersed in the polyamideimide resin.

5. The cylinder head for an engine of claim 1, wherein: the adiabatic coating layer has a thickness of 50 μm to 500 μm.

6. The cylinder head for an engine of claim 5, wherein the adiabatic coating layer has a thermal conductivity of 0.54 W/m or less in a thickness of 120 to 200 μm.

7. The cylinder head for an engine of claim 1, wherein: the adiabatic coating layer includes 5 to 50 parts by weight of the aerogel based on 100parts by weight of the polyamideimide resin.

8. The cylinder head for an engine of claim 1, wherein the adiabatic coating layer including the polyamideimide resin is dispersed in a high boiling point organic solvent or aqueous solvent and the aerogel is dispersed in a low boiling point organic solvent as the adiabatic coating layer.

9. The cylinder head for an engine of claim 8, wherein the high boiling point solvent includes anisole, toluene, xylene, methyl ethyl ketone, methyl isobutyl ketone, ethyleneglycol monomethylether, ethyleneglycol monoethylether, ethyleneglycol monobutylether, butyl acetate, cyclohexanone, ethyleneglycol monoethylether acetate (BCA), benzene, hexane, DMSO, N,N'-dimethylformamide, or a mixture of two or more kinds thereof.

10. The cylinder head for an engine of claim 8, wherein the low boiling point organic solvent includes methyl alcohol, ethyl alcohol, propyl alcohol, n-butyl alcohol, iso-butyl alcohol, tert-butyl alcohol, acetone, methylene chloride, ethylene acetate, isopropyl alcohol, or a mixture of two or more kinds thereof.

11. The cylinder head for an engine of claim 8, wherein the aqueous solvent includes water, methanol, ethanol, ethyl acetate, or a mixture of two or more kinds thereof.

12. The cylinder head for an engine of claim 1, wherein the aerogel includes one or more kinds of compounds selected from the group consisting of silicon oxide, carbon, polyimide, and metal carbide.

13. The cylinder head for an engine of claim 1, wherein the polyamideimide resin has a weight average molecular weight of 3,000 to 300,000 or 4,000 to 100,000.

14. The cylinder head for an engine of claim 1, wherein the aerogel has a specific surface area of 100 cm$^3$/g to 1,000 cm$^3$/g, or 300 cm$^3$/g to 900 cm$^3$/g.

* * * * *